United States Patent [19]

Moussalli

[11] Patent Number: 5,046,673

[45] Date of Patent: Sep. 10, 1991

[54] CONTROLLED PROGRAMMABLE ELECTRONIC WINDING

[75] Inventor: Francis S. Moussalli, Charlottesville, Va.

[73] Assignee: Institute of Textile Technology, Charlottesville, Va.

[21] Appl. No.: 534,373

[22] Filed: Jun. 7, 1990

Related U.S. Application Data

[63] Continuation of Ser. No. 265,767, Nov. 1, 1988, abandoned.

[51] Int. Cl.[5] ..... B65H 54/00; B65H 59/20

[52] U.S. Cl. ..... 242/18 R; 242/45; 242/150 M; 242/178

[58] Field of Search ..... 242/18 R, 36, 37, 45, 242/147 R, 147 M, 149, 150 R, 150 M, 153, 154, 155 R, 155 M, 159, 176, 177, 178

[56] References Cited

U.S. PATENT DOCUMENTS

| | | | |
|---|---|---|---|
| 1,985,603 | 12/1934 | Elssner | 242/176 X |
| 2,190,797 | 2/1940 | Moncrieff et al. | 242/176 X |
| 3,141,624 | 7/1964 | Gentle et al. | 242/45 X |
| 3,300,161 | 1/1967 | Hermanns | 242/154 |
| 3,494,564 | 2/1970 | Lindemann et al. | 242/45 |
| 4,059,239 | 11/1977 | Hori et al. | 242/45 X |
| 4,120,462 | 10/1978 | Raasch et al. | 242/45 |
| 4,313,578 | 2/1982 | Van Wilson et al. | 242/150 M X |
| 4,538,772 | 9/1985 | Davies | 242/45 X |
| 4,650,133 | 3/1987 | White et al. | 242/36 |

*Primary Examiner*—Stanley N. Gilreath
*Attorney, Agent, or Firm*—Ronald P. Kananen

[57] ABSTRACT

A method and apparatus for winding yarn to produce a wound yarn package having a variable density profile. The variable density profile in the wound yarn is produced by variably tensioning the yarn during the winding process by an electrical apparatus which is responsive to a programmed control signal to provide variable tension on the yarn. The density profile thus produced is preferably a progessively variable density profile. In a preferred embodiment, the method is carried out with a precision winding machine with an electromagnetic tensioner. A controlled sequence of control signals is applied to the tensioner to provide a correspondingly varying tension on the yarn.

20 Claims, 9 Drawing Sheets

| LAYER NUMBER | VOLUME [cm^3] | MASS [GRAMS] | DENSITY [g/dm^3] | DENSITY AVG. DEN. | PERCENT VOLUME | CUM% VOLUME |
|---|---|---|---|---|---|---|
| 1 | 815.90 | 236.50 | 289.86 | 0.82 | 23.02 | 23.02 |
| 2 | 1152.40 | 374.50 | 324.97 | 0.92 | 32.51 | 55.52 |
| 3 | 1576.60 | 645.30 | 409.30 | 1.15 | 44.48 | 100.00 |
| TOTALS | 3544.90 | 1256.30 | | | 100.00 | |
| AVERAGES | | | 354.40 | | | |

| | VOLTS | TENSION (GRAMS) | TIME (MINUTES) | VOLUME (cm^3) | MASS (GRAMS) | DENSITY (g/dm^3) |
|---|---|---|---|---|---|---|
| | 16.74 | 15 | 6.50 | 435.40 | 150.00 | 344.51 |
| | 24.60 | 30 | 12.00 | 834.00 | 320.00 | 383.69 |
| | 26.10 | 33 | 34.00 | 2234.70 | 876.00 | 392.00 |
| TOTALS | | | 52.50 | 3504.10 | 1346.00 | |
| AVERAGES | | | | | | 384.12 |

| | VOLTS | TENSION (GRAMS) | TIME (MINUTES) | VOLUME (cm^3) | MASS (GRAMS) | DENSITY (g/dm^3) |
|---|---|---|---|---|---|---|
| | 16.74 | 15 | 6.50 | 542.20 | 165.40 | 305.05 |
| | 24.60 | 25 | 12.00 | 853.80 | 304.60 | 356.76 |
| | 26.10 | 37 | 34.00 | 2135.20 | 879.80 | 412.05 |
| TOTALS | | | 52.50 | 3531.20 | 1349.80 | |
| AVERAGES | | | | | | 382.25 |

| VOLTS | TENSION (GRAMS) | TIME (MINUTES) | VOLUME (cm^3) | MASS (GRAMS) | DENSITY (g/dm^3) |
|---|---|---|---|---|---|
| 9.3-13.7 | 15-20 | 10 | 785.60 | 260.50 | 331.59 |
| 15.2-17.5 | 25-35 | 15 | 1045.10 | 403.60 | 386.18 |
| 18.6 | 38 | 27 | 1739.20 | 703.20 | 404.32 |
| TOTALS | | 52 | 3569.90 | 1367.30 | |
| AVERAGES | | | | | 383.01 |

CONTROLLED PROGRAMMABLE ELECTRONIC WINDING

This application is a continuation of application Ser. No. 07/265,767, filed Nov. 1, 1988, now abandoned.

BACKGROUND OF THE INVENTION

This invention relates to a method and apparatus for controlled programmable electronic winding of yarn in the textile industry. More particularly, this invention relates to a method and apparatus for yarn winding in which the geometry of a yarn package is variably controlled electronically according to a predetermined program. Still more particularly, this invention relates to an automatic yarn winding system which is electronically programmable to achieve pre-programmed density profiles in a yarn package which are uniform in shape, density, and weight averages between take-up packages made of the same yarn.

In the textile industry, yarn is generally packaged for various steps in textile processing as a plurality of wraps of yarn disposed about a core. The ideal characteristics of a package of yarn usually depend upon the end use of the package and the characteristics of the yarn so that yarn packaged for weaving or warping may be packaged differently than yarn intended for dyeing. By way of example, a package of yarn for weaving should usually have a mild wrap angle about the core and the yarn-to-yarn friction should be minimized during unwinding. Such a weaving package should also usually be as heavy as possible and include a workable transfer tail in order to minimize labor. In contrast, a package of yarn destined to be dyed should be porous in order to allow the dye liquor to flow through the packaged yarn with a minimum of resistance and a resulting minimum loss of pressure. Thus, a number of machines and devices have been developed for winding yarn in such packages.

Generally, such winding machines have been of two types, i.e., conventional winding machines which generally include either a grooved drum or a cam guide for the yarn, and so-called precision winding machines which include a propeller driven with a constant wind ratio. A particularly suitable winder assembly wherein the winder is controlled primarily mechanically is available from Shärer Textile Machine Works, Ltd., Switzerland. In that winder, yarn from a supply package is provided through a mechanical tensioner which has a fixed tension to the propeller to be wound at a fixed, constant wind ratio on a package. To vary the wind ratio, the gears connecting the drive to the propeller must be changed. In addition, the back pressure on the yarn exhibited by the back pressure system of the machine can also be adjusted. However, such adjustments can only be made mechanically when the machine is not running, and there is no effective way to adjust the geometry of the wound package during operation. Such shortcomings are significant not only from a labor and production standpoint, but also from the viewpoint of the end use of the package.

For yarn dyeing, for example, a precision wound package is more likely to permit an easier flow of dye liquor from the interior of the core through the packaged yarn to the exterior of the yarn package than a random wound package of yarn. Unfortunately, even yarn packages which are precision wound using conventional techniques, such as by the Schärer winder, do not consistently produce a controllable density profile for the yarn package. In random winding, for example, the yarn is wound over the circumference of the support by tangential friction at an angle determined by the constant groove pattern in the drum. As the package diameter increases, the length of yarn delivered for a wrap also increases so that the distance along the support between the beginning and the end of a wrap must also increase to maintain the ratio contrast. Therefore, the number of wraps is highest next to the tube and this number gradually decreases as the diameter of the package increases. Since wrapping is produced through friction; therefore the larger the number of wraps will result in the larger amount of friction. And, since increased friction will result in increased density, it ensues that the density in a random wound package will be at its highest in the layers next to the tube and that density will gradually decrease as the diameter of the package increases. In addition, so-called "ribbons" are formed when successive layers of yarn accumulate on top of or adjacent one another. The yarn density of such ribbons is higher than that of the package, thus interfering with liquor flow through the yarn mass during dyeing. While mechanical expedients have been tried with some success, the density of the yarn package is not readily mechanically controllable during random winding. In contrast, during precision winding, package density is not regulated by friction. On the contrary, a slightly lower density of the yarn layers next to the tube results from a relatively slow speed during the first few seconds of a machine start. That density remains relatively constant throughout the package.

Thus, it is an overall objective of this invention to provide controlled electronic programmable winding for yarn packages. Such an invention would be useful to increase the productivity and the quality of yarn dyeing by controlling the density profile for the yarn package with favorable results. For example, a consequence of a low pressure drop across the yarn package during dyeing is that the yarn mass in the dyeing machine can be increased, thereby effectively increasing the yarn capacity and dyeing capacity of the dyeing machine. Moreover, the package geometry can be improvedly controlled according to the invention.

It is another general objective of this invention to provide a method for controlled electronically-programmed winding for packaging yarns.

It is still another objective of this invention to provide a method and apparatus for winding yarn according to a program implemented through an electronic apparatus to provide a predetermined density profile to the packaged yarn.

It is still another objective of this invention to provide a method and apparatus for controlling yarn package geometry by electrically controlling the tension on the yarn during winding according to a predetermined program to provide a particular geometry and density profile to the yarn package.

It is still another objective of this invention to provide a method and apparatus for controlling yarn package geometry and its density profile by electronically controlling, by a predetermined program, the tension on the yarn.

These and other objectives of this invention will become apparent from the detailed description of the invention which follows, taken in conjunction with the accompanying drawings.

BRIEF SUMMARY OF THE INVENTION

Directed to achieving the foregoing objectives and to overcoming the problems in achieving adequate control of the geometry of yarn packages, the method according to the invention includes a step of programming the winding of yarn to achieve a desired geometry, including density profile. In a preferred embodiment, the method includes the step of controlling the tension on a yarn during winding by an electrical or electronic apparatus such as an electromagnetic tensioner, according to a predetermined sequence to achieve a predetermined density profile. Another aspect of the method according to the invention includes the step of relating the electrical voltage applied to a variable electronic tensioner such as an electromagnetic tensioner for tensioning yarn during winding according to sequence related to time, thus to produce a yarn package which has a variable density profile which varies with the radius of the wrapped yarn from the core. Preferably, such a profile includes an arrangement whereby the density is a continuous function of the radius of the wrap of yarn from the outer diameter of the core. A presently preferred density profile includes a region near the core which is relatively less dense to permit significantly improved dye liquor flow, merging into a region which is relatively more dense in the central region of the package to provide desired strength and geometry to the yarn package, merging continuously into an outer region which is still more dense. Other profiles are possible.

An apparatus according to the invention includes a precision winding apparatus having a means for tensioning yarn traveling from a yarn source of supply, such as a supply reel, the tensioning means including an electrical or electronic apparatus which is variably controllable according to a predetermined program or sequence to control the tension on the yarn during wrapping by the precision winding apparatus. By variably controlling the tensioning of the yarn, such as by a variably-controlled electromagnetic tensioner, the package geometry and the density of the yarn wrap can be controlled.

These and other features of the invention will become apparent from the detailed description of the invention which follows taken in conjunction with the accompanying drawings.

DETAILED DESCRIPTION OF THE PREFERRED EMBODIMENTS

Figure 1:
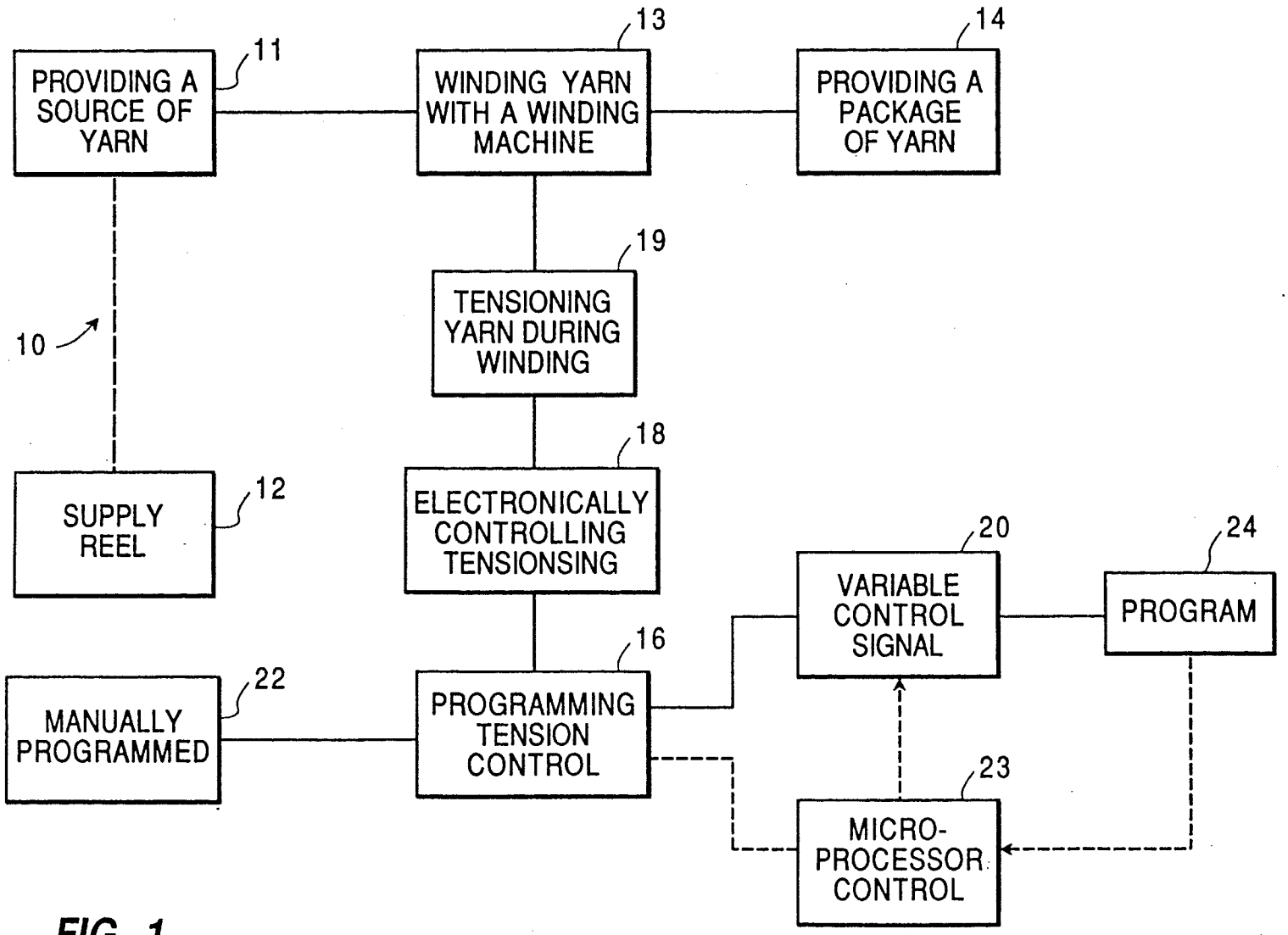
FIG. 1 is a block diagram of the steps of the method according to the invention.

FIG. 1 illustrates, in block diagram form, the method according to the invention as designated by the reference numeral 10. The method 10 includes an initial step 11 of providing a source of yarn, such as from a supply reel 12 on a winding machine. The yarn thus provided is wound in a winding step 13 to provide an improved wound package of yarn at the step designated by the reference numeral 14. The winding step 13 may be performed by either random winding, or by precision winding, by machines which are known to the art.

According to the invention, the winding step 13 is programmed, as indicated at the step 16, to conrol a step of electrically or preferably electronically controlling the winding step, as indicated in the step 18. In a preferred embodiment of the method, the step of controlling is performed by controlling the step of tensioning 19 on the yarn provided in the step 11 at a suitable location in the practice of the winding step 13 by an electronic tensioning device. By providing a variable control signal to the electronic tensioning device, as shown in the step 20, either manually such as in step 22, or from a programmed source, as in step 24, the tension applied to the yarn during winding is effectively controlled to produce a package of yarn having a density which varies in the package according to a predetermined pattern. The programmed source for the control signal may alternatively include a microprocessor 23 which is programmed by a diskette, for example, to output from a suitable voltage source, for example, a voltage signal which varies as a function of time according to the predetermined program. A suitable apparatus for the practice of the invention, as will be discussed in connection with FIGS. 2-8, is a precision winder such as is available from Schärer having its mechanical tensioner replaced by a variably-controlled electronic tensioner, such as is available from Appalachian Electronic Instruments, Inc., Ronceverte, W. Va. and shown for example in U.S. Pat. No. 4,313,578 which is incorporated by reference for completeness of disclosure.

A main feature of the method of the invention resides in its ability to control the density of the yarn package so wound by controlling the tension on the yarn during the winding process. In a specific example of practicing the method of the invention, the voltage applied to the variably-controlled tensioner is gradually or stepwise increased as the yarn package builds up. Thus, an important aspect of the invention is its recognition that the density profile of the yarn package ca be controlled by controlling the tension by steps 16, 18 and 19 on the yarn during the winding step 13. When the density is thus controlled, the geometry of the yarn package is also controlled, as is its density profile.

In a specific application of the invention to a precision winder from Schärer, the yarn from the feed package was overfed to neutralize the tension of the feed package to a level below 5 grams of tension as measured on a Rothschild tensionmeter. Preferably, the feed yarn is overfed in a range up to 200% of the normal machine speed, but most preferably the overfeed rate is between 120 and 150% of the normal machine speed. The overfeeding device could be mechanical, but preferably is electronically controlled to permit programming the overfeeding during the winding operation. In practice, the tensioning program takes into account other mechanical features of the winding machine to which it is applied that affect the tension on the yarn. For example, in the Schärer system PSM-21, the tension on the yarn is increased mechanically as the take-up yarn package grows. This feature is known in the art as "back pressure reduction" and is controlled by the settings of the mechanical system which cannot be automatically changed while winding. As a specific example of the practice of the invention with a Schärer PSM-21 winding machine retrofitted with an Appalachian electromagnetic tensioner (EMT), an EPROM was connected to the EMT and monitored by a voltmeter. By keeping the tension constant and adjusting the voltage by hand, such as is shown in step 22, through a knob on the EPROM, yarn packages were successfully wound at respective tensions of 5, 10, and 15 grams at respective radial distances of 2, 4, and 6 cm. from the perforated core tube to produce a yarn package having a variable density with the least dense region near the core. Thus, a principal feature of the method of the invention recognizes that a programmed relationship between a control signal applied to an electronically controlled device, such as an EMT, applied to a winding machine, produces a wound yarn package having a variable tension which varies with the radius of the yarn package as measured from the outer diameter of the core tube.

Figure 2:
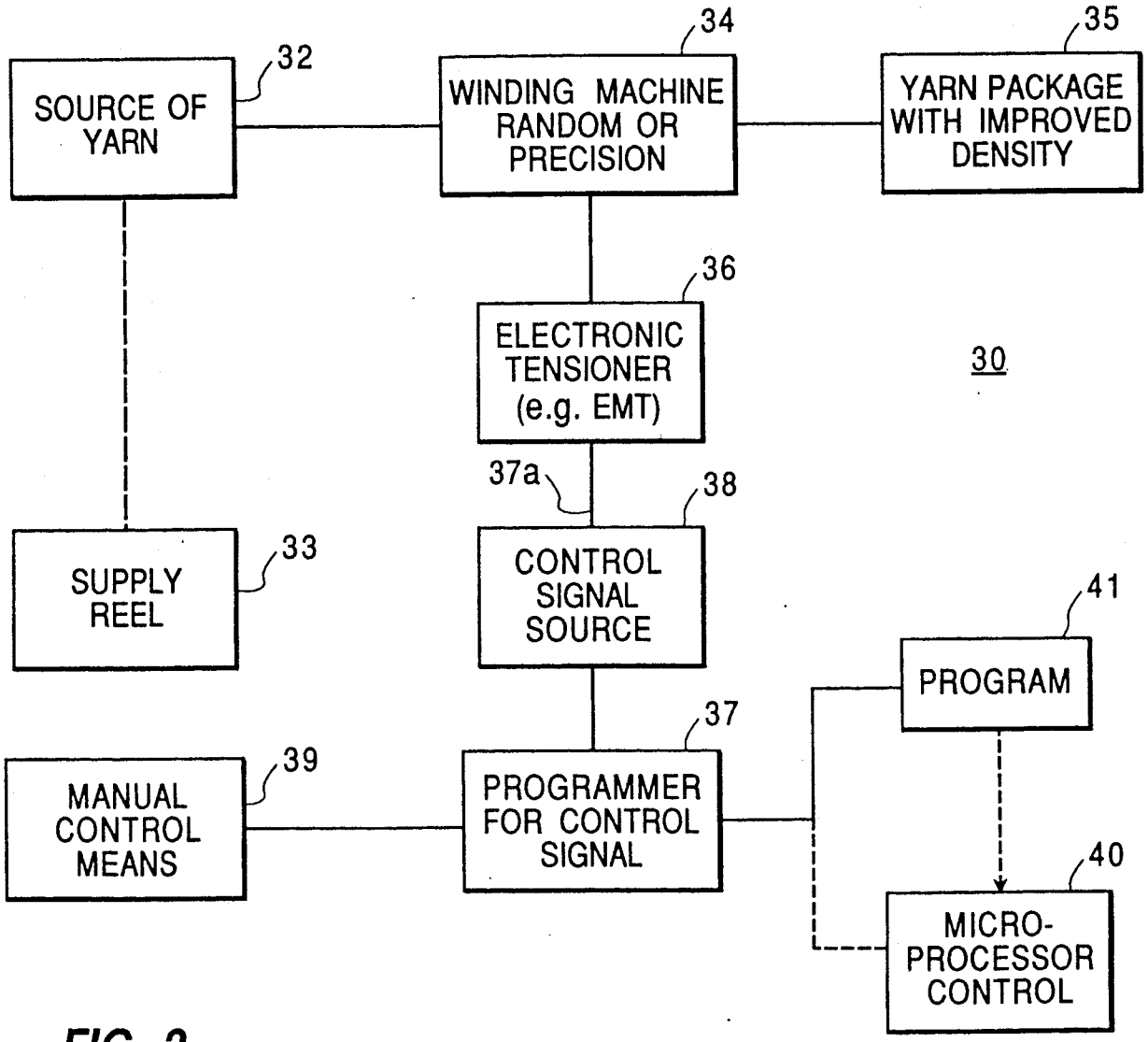
FIG. 2 is a schematic block diagrammatic view of the controlled electronic programmable apparatus according to the invention for practicing the method of the invention.

FIG. 2 is a representative block diagram of the components of an apparatus for practicing the method of the invention as shown generally at a reference numeral 30. A source 32 of yarn, such as a supply reel 33, provides yarn to a winding machine 34, such as one of those of the type described. An electromagnetic tensioner 36, such as the one described above, provides tension on the yarn while it is being wound onto an improved yarn package 35 according to the invention. The electromagnetic tensioner 36 is controlled by a control signal 37*a* produced from a programmed source 38 controlled by a programmer 37, such as a manual source 39, or a program 41, or a computerized source such as a microprocessor 40 operating according to the program 41, to provide a predetermined control signal 37*a* for varying the tension exerted on the yarn by the EMT 36. The apparatus may be provided as a part of the original winding equipment, or as a retrofitted device replacing the mechanical tensioner normally provided on a winding machine. The control signal source 38 thus provides a programmed sequence of electrical control signals to the electronic tensioner 36 as controlled by the programmer 37. For the particular EMT described, the control signals are voltage signals.

Figure 3:
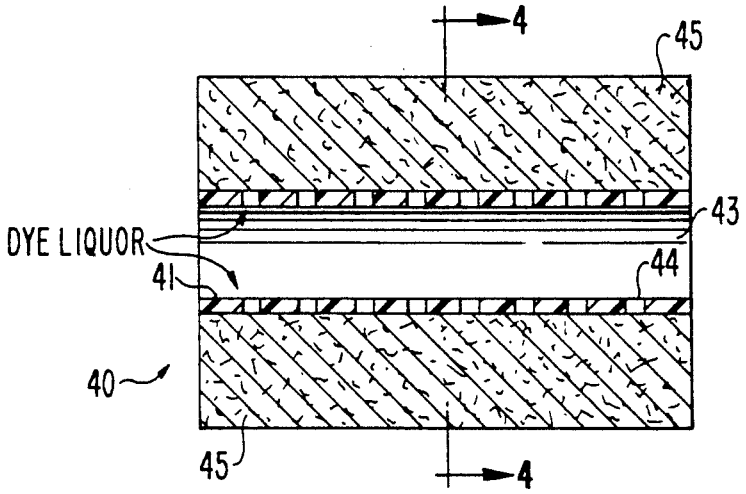
FIG. 3 is a side cross-sectional view of a typical yarn package showing yarn wound about a core, according to the invention.
Figure 4:
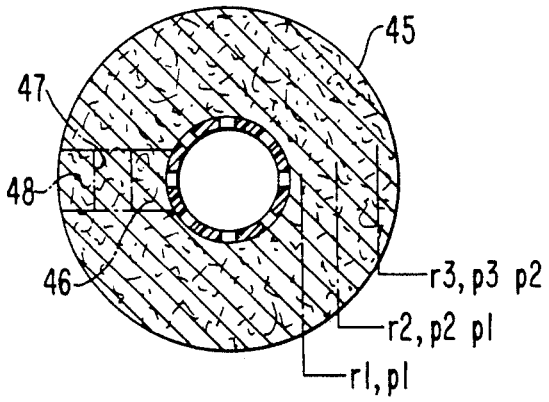
FIG. 4 is a cross-sectional view taken along line 4-4 of the yarn package of FIG. 3 showing a density variation in the packaged yarn as a function of the radius of the wound yarn.

FIG. 3 is a side cross-sectional view of a yarn package 40, having a perforated core tube 41, about which yarn 42 is wound by the winding machine 34. For use in the dyeing of yarn, as is well known, the core tube 41 is perforated in various shapes 44 to provide a flow path for dye liquor from the interior 43 of the tube 41 through the perforations 44 and then through the yarn 42 packaged about the tube in a predetermined pattern, as is known in the art. The dye liquor exits the yarn 42 at its outermost diameter 45 to return to be recirculated in the dyeing machine (not shown). FIG. 4 shows a side cross-sectional view taken along line 4—4 of FIG. 3, illustrating a significant feature of a yarn package produced according to the invention. That feature is that the density of the yarn, as measured from the inside of the yarn package, varies as a function of the radius of the yarn from the outer diameter of the core tube. FIG. 5 shows a representative family of curves of the density profiles in the yarn 42 as packaged according to the invention.

In producing an improved package of yarn according to the invention, for a typical yarn, it is desired to have a region 46 nearest the core tube 41 with a lesser density, continuously merging into a region 47 having a greater density about in the middle of the yarn package, finally merging into a region 48 of still greater density near the outermost diameter 45 of the yarn. With such a density profile, the geometry of the yarn package can be controlled significantly, while producing a yarn package which has significant advantages in the dyeing process. For example, with such a package, the flow of dye liquor in the region 46 most adjacent the core tube 41 is improved, better assuring a smooth and even flow of dye liquor through the yarn package as a whole and specifically through the adjacent regions 47, 48. Thus, the dyeing process is improved and consistent quality dyeing is better assured than with yarn packages to which little or scant attention has been paid to the package density. As indicated in FIG. 4, the density of the yarn 42 is least near the core tube 41 and greatest near the outer diameter 45 of the yarn. However, for specific applications, other density profiles can be developed following the same principles in the invention.

Figure 5A:
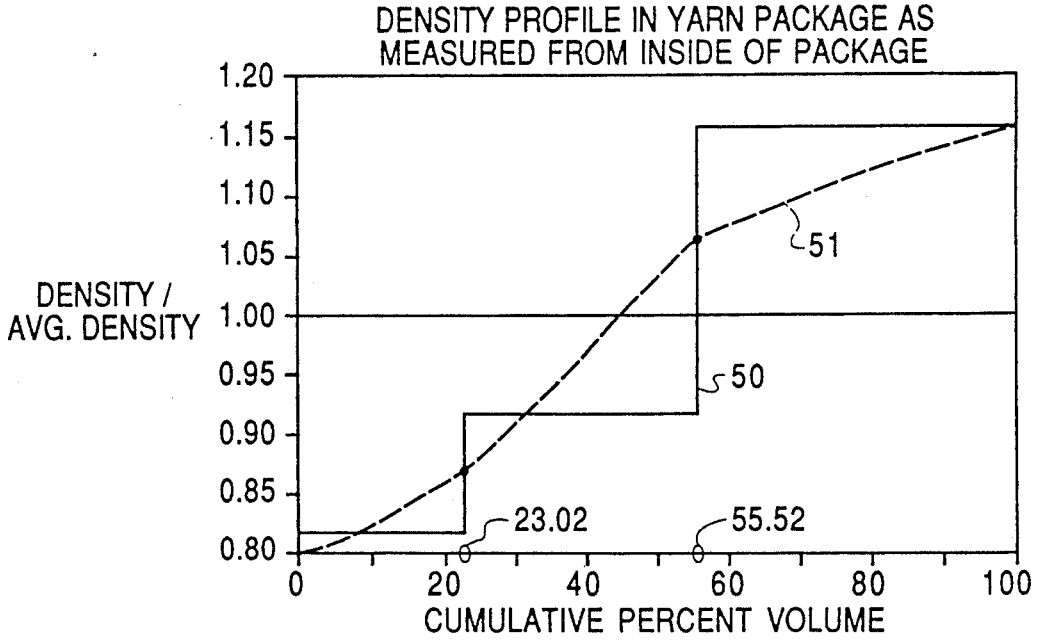
FIG. 5A shows a representative profile of yarn density as measured from the inside of the core.

FIG. 5A shows a typical density profile at curve 50 in a yarn package made according to the invention. By sampling the yarn package at three discrete locations in the package and knowing the mass of the package at that location and its volume, the density can readily be calculated. FIG. 5A thus shows a plot 50 of the observed data. It should be understood that the density varies continuously through the radius of the yarn on the core, not discretely as the sampling technique might erroneously suggest. Thus, curve 51 is a projected extrapolation of the actual density variation as a function of radius.

Figure 5B:
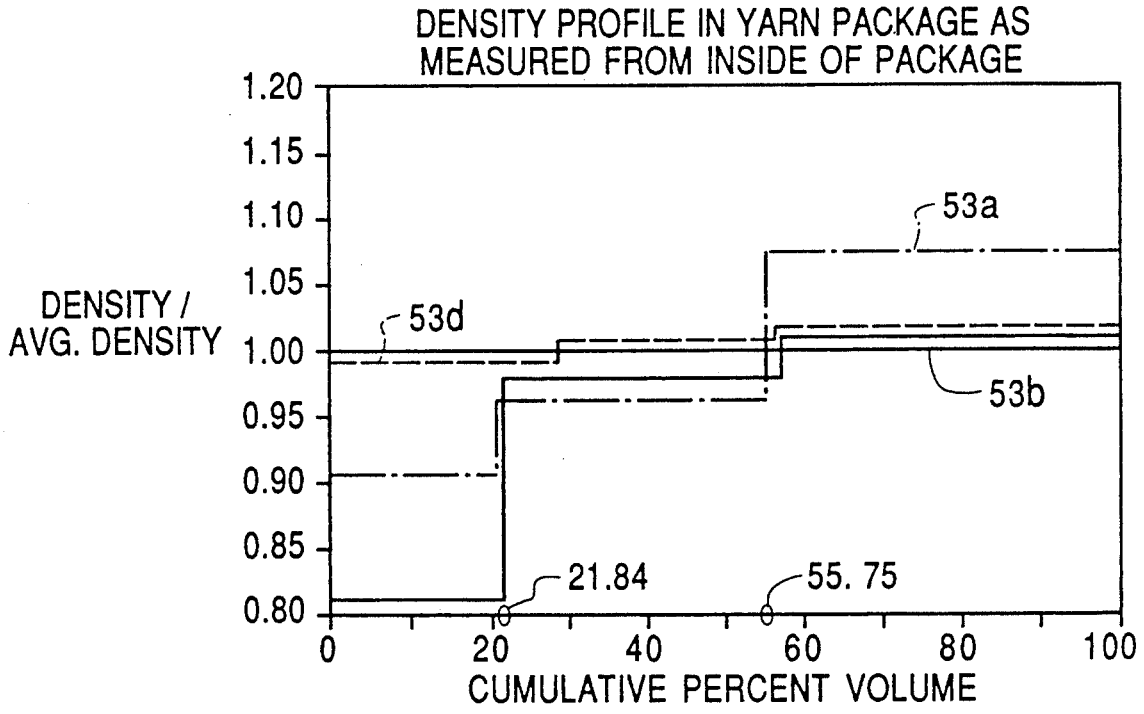
FIG. 5B is a family of curves showing alternative representative densities programmed into the wound yarn for various reasons.

FIG. 5B shows a family of curves of density profile that can be obtained according to the invention. By recognizing the relationship between tension and the density profile, the geometry and density characteristics of the yarn package can readily be preprogrammed to achieve the desired profile, taking into account the intended end use of the yarn, the type of yarn and its shrinkage characteristics, for example, and the wrap profile on the core tube, among other factors. Thus, FIG. 5B should be considered as representative of a family of density profiles 53*a* and 53*b* that can be obtained with the invention. The density profile of a conventionally wound package as shown at curve 53*d*, demonstrates the improved results.

Figure 6:
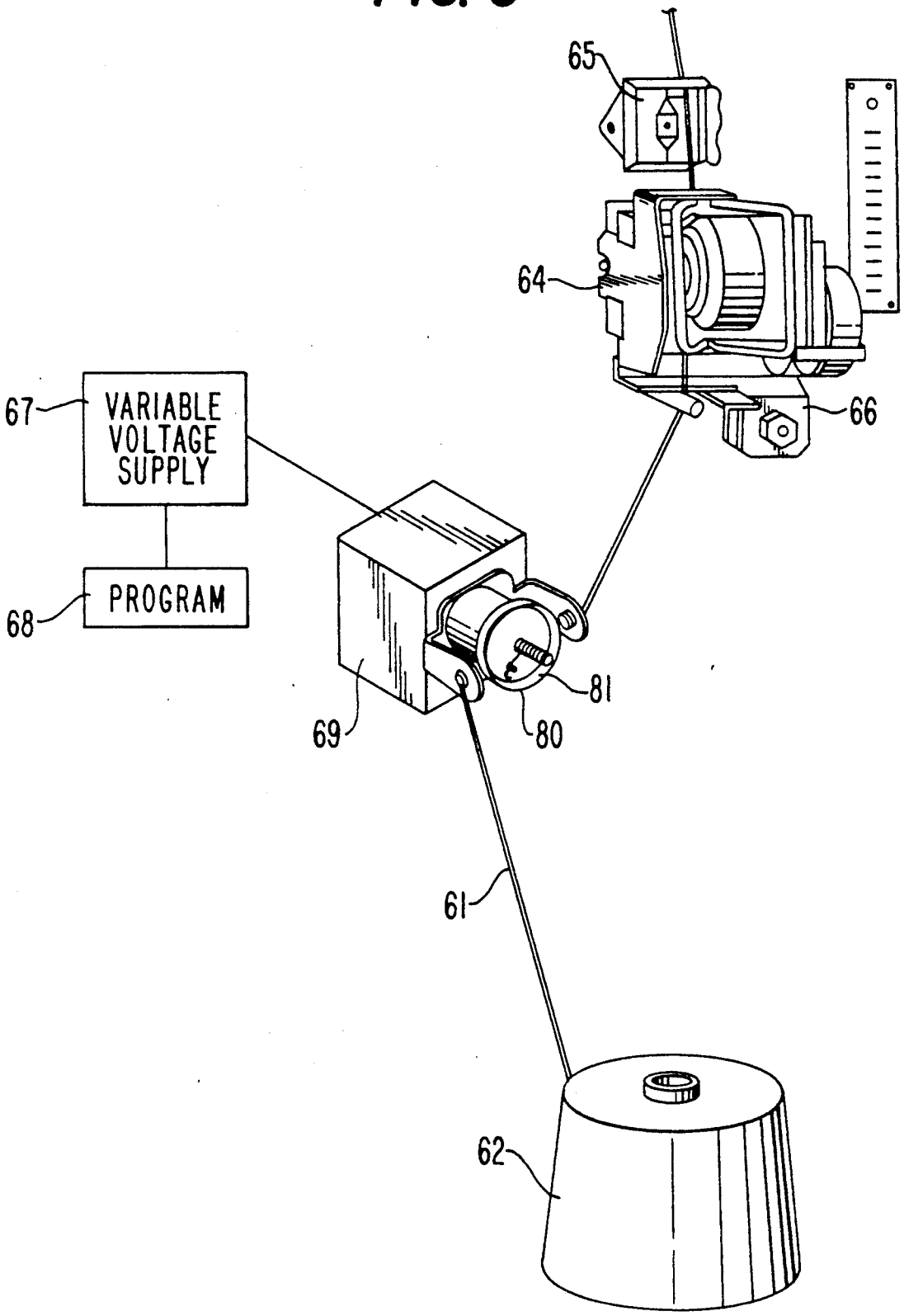
FIG. 6 is a perspective view, partially in block of the components of a portion of a prior art precision mechanical winding machine showing a preferred embodiment of a programmed electromagnetic tensioner applied to the machine in place of its mechanical tensioner.

FIG. 6 shows a portion of a Schärer PSM-21 precision winder, the details of which are well known to the art as a precision winding machine to which the invention is applicable. As shown in FIG. 6, the yarn 61 is taken from a supply package 62 to an electromagnetic tensioner 69 of the type described and then through a pre-clearer 66, a mechanical tensioner 64 and a yarn stop motion device 65, to be wound on a take-up package (not shown). Such a machine is supplied with a balloon controller at the location at which the EMT 69 is preferably provided. A variable voltage source for the EMT 69 is shown at the block 67, under the control of a programmed source 68, as described more generally in connection with FIGS. 1 and 2. FIG. 6 thus illustrates a preferred embodiment of the application of hardware for the practice of the invention.

Figure 7:
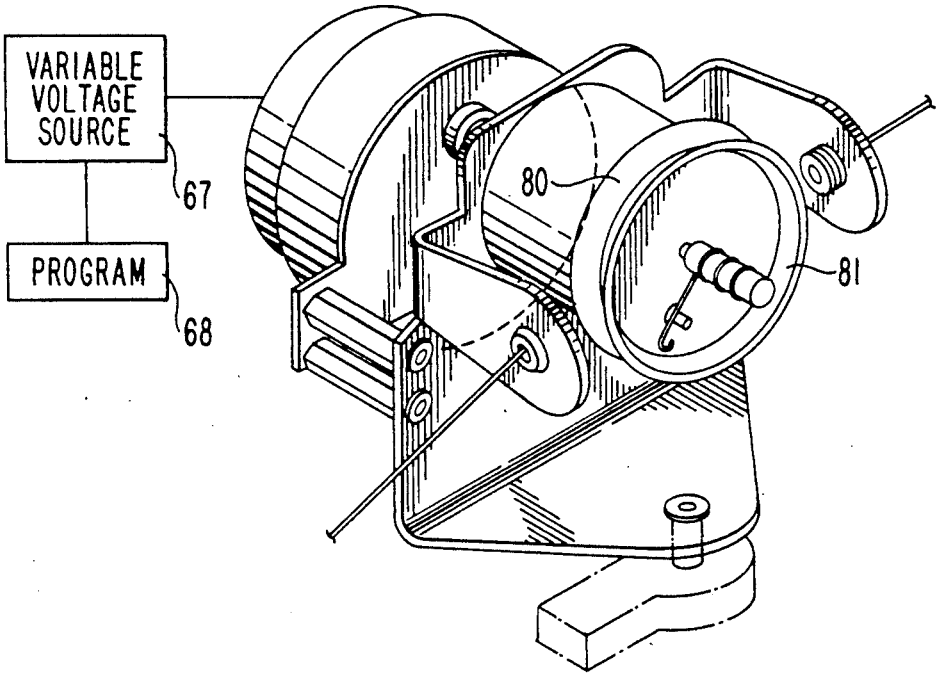
FIG. 7 is a perspective view, partially in block form, of a pertinent portion of a variably-controlled electromagnetic tensioner known to the art which is suitable for use with the embodiment of FIG. 6.
Figures 8, 8A:
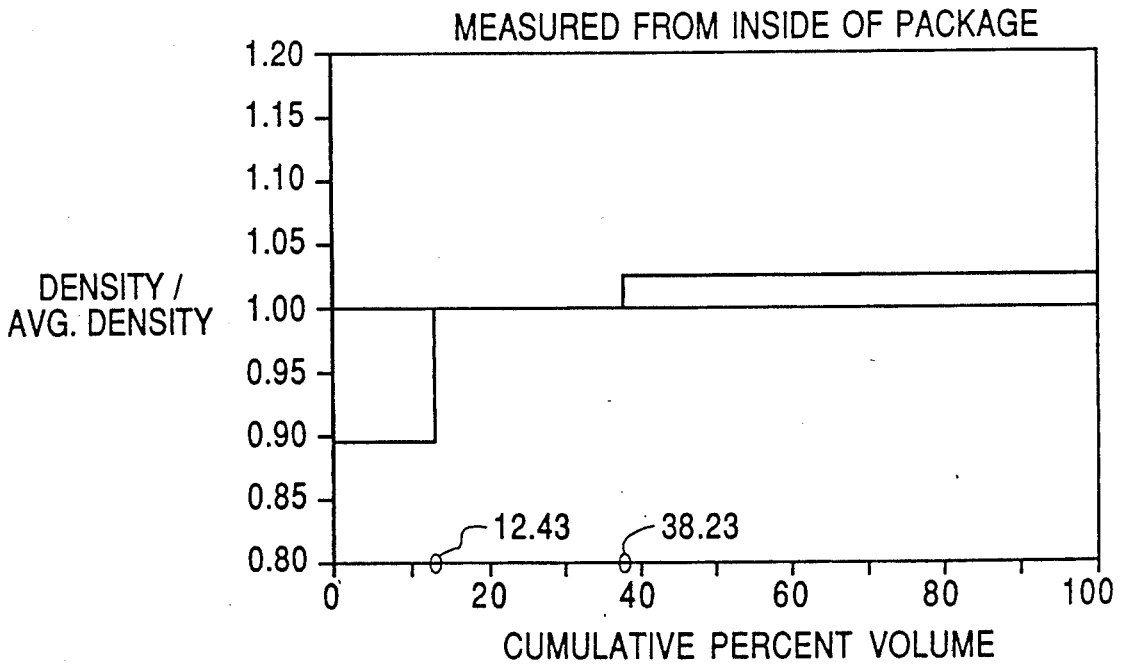
FIG. 8 shows a representative profile of yarn density in a three watt tensioning device as measured from the inside of the core.
FIG. 8A shows a graphic representation of the density profile of FIG. 8.

FIG. 7 is a perspective view of a portion of the EMT 69 shown in FIG. 6, taken from FIG. 8 of U.S. Pat. No. 4,313,578 which was discussed above. The yarn 61 passes through the discs 80 and 81 on which the tension is variable according to the control signal provided to the EMT 69 in accordance with the capabilities of that device.

FIGS. 8 and 8A show a representative density profile in a yarn package made according to the invention using a 3 watt tensioning device. FIG. 8A shows the profile graphically. By sampling the yarn package at three discrete locations in the package and knowing the mass of the package at that location and its volume, the density can be readily calculated. It should be understood that the density varies continuously through the radius of the yarn on the core, not discretely as a sampling technique might erroneously suggest.

Figures 8B, 8C:
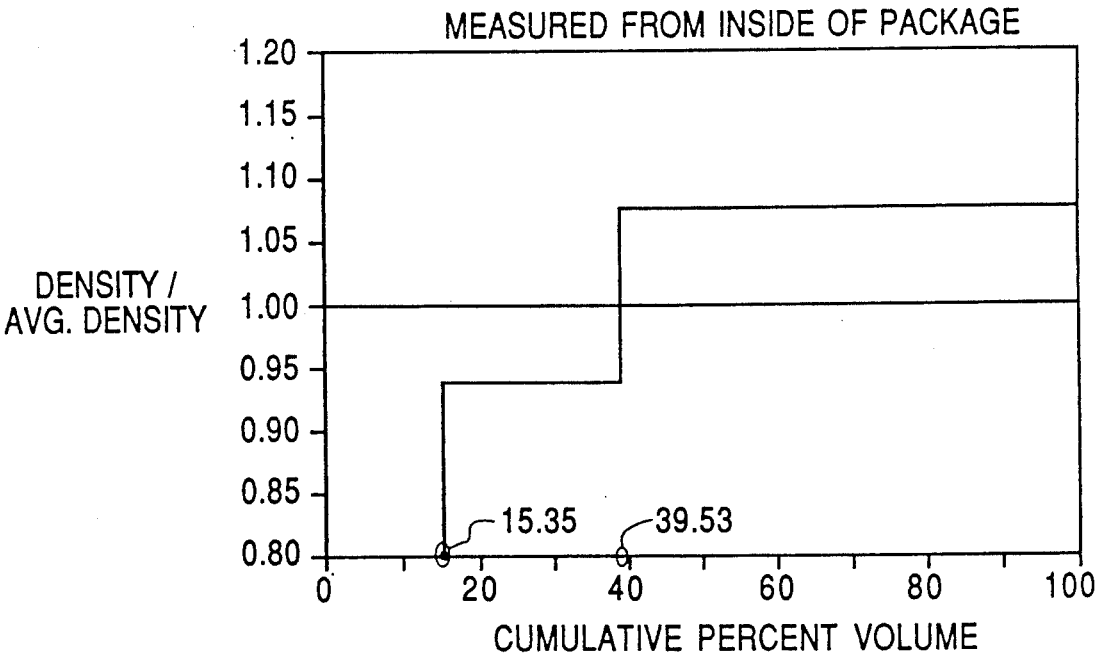
FIG. 8B shows a representative profile of yarn density of a 3.5 watt tensioning device as measured from the inside of the core.
FIG. 8C shows a graphic representation of the density profile of FIG. 8B.

FIGS. 8B and 8C show a representative density profile in a yarn package made according to the invention using a 3.5 watt tensioning device. Again, by sampling the yarn package at three discrete locations in the package and knowing the mass of the package at that location and its volume, the density can be readily calculated. FIG. 8C shows the profile graphically. It should be understood that the density varies continuously through the radius of the yarn on the core, not discretely as the sampling technique might erroneously suggest.

Figures 8D, 8E:
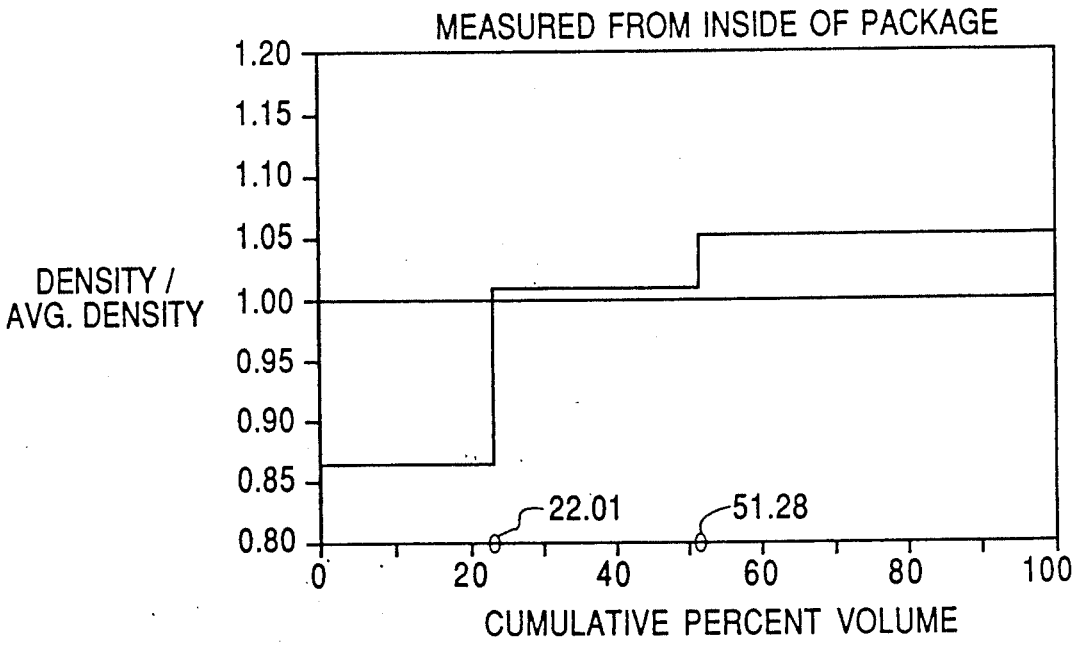
FIG. 8D shows another representative profile of yarn density for a 3.5 watt tensioning device as measured from the inside of the core.
FIG. 8E shows a graphic representation of the yarn density of FIG. 8D.

FIGS. 8D and 8E show another representative density profile in a yarn package made according to the invention using a 3.5 watt tensioning device. By sampling the yarn package at three discrete locations in the package and knowing the mass of the package at that location and its volume, the density can be readily calculated. FIG. 8E shows the profile graphically. It should be understood that the density varies continuously through the radius of the yarn on the core, not discretely as the sampling technique might erroneously suggest.

FIGS. 8 to 8E show three representative examples of practicing the invention with a electromagnetic tensioner, relating the voltage to the desired tension to produce a yarn package. For each example, the volume, mass and density of the package, as well as the packaging time, is reported, to produce the density profile in the yarn package as measured from the inside of the package as correspondingly shown. In each case, the density progressively increases with the volume of the package. It may be noted that the data of Representative Example I was collected using a 3 watt tensioning apparatus which somewhat limited the maximum tension applied to the yarn making up the package. However, Representative Examples II and III were developed using a 3.5 watt tensioning device.

While this invention has been described in conjunction with a specific embodiment thereof, it is evident that many alternatives, modifications and variations will be apparent to those skilled in the art particularly to alternative tensioning controls and programs therefor. Accordingly, it is intended to embrace all alternatives, modifications and variations that fall within the scope of the appended claims.

What is claimed is:

1. A method for winding yarn, comprising the steps of:

providing a length of yarn; and winding said length of yarn in a package having multiple layers of yarn wrap the winding step including a step of starting the winding at a first low tension in order to achieve low density and then programmably variably progressively increasing the tension on the yarn during the winding step from the innermost layers to outermost layers radially of the yarn package according to a predetermined sequence to obtain a progressively higher yarn density profile radially outward from the core to produce an improved package geometry in a yarn package with a variable density profile.

2. The method as set forth in claim 1 further comprising the step of programmably variably increasing the tension on the yarn during winding by providing an electronically-controlled, programmed apparatus which provides progressively increased programmed tension to the length of yarn during winding.

3. The method as set forth in claim 2 wherein the step of programmably variably increasing the tension on the yarn during winding is carried out by providing a programmed tension as a function of time and magnitude to the length of yarn during winding.

4. The method as set forth in claim 3 wherein the step of winding further includes a step of winding a yarn package having a variable density profile which varies as a function of the control signals applied to said electromagnetic tensioner.

5. The method as set forth in claim 2, further comprising the step of progressively increasing the tension on the yarn by providing an apparatus which includes an electromagnetic tensioner in circuit with a variable source of control signals for controlling the apparatus and controlling said apparatus to vary the tension on the yarn for predetermined times during winding in accordance with the control signals.

6. The method as set forth in claim 5, wherein the step of increasing the tension includes the step of providing a source of variable signals as the control signals to said electromagnetic tensioner.

7. The method as set forth in claim 6, wherein the step of increasing includes a step of providing the density profile with a least dense region nearest the core, a more dense region intermediate the core and an outer diameter of the yarn package, and a most dense region nearest the outer diameter of the yarn package.

8. The method as set forth in claim 2 wherein the step of increasing includes a step of varying the density of the yarn package in a direct relationship with the signal applied to said electronically-controlled apparatus.

9. The method a set forth in claim 1 wherein the step of winding further includes a step of winding a yarn package having a variable density profile which varies as a function of the radius of the packaged yarn from a core.

10. The method as set forth in claim 9 wherein the step of increasing further comprises the step of varying the density of the yarn package in a direct relationship with the tension applied to said length of yarn during packaging.

11. An apparatus for winding yarn, comprising:

means for winding a length of yarn from a source of yarn to be wound in a package having multiple layers of yarn wraps;

tensioning means for starting the winding at a first low tension in order to achieve low density and then continuously tensioning said length of yarn while winding same by variably progressively increasing tension produced by said tensioning means from the innermost layers to outermost layers radially of the yarn package with a programmed control signal for varying said tension in accordance with said signal, said tensioning means including an electrical apparatus variably responsive to a control signal applied thereto to provide a variable tension in response to said control signal, whereby a wound yarn package having a variable progressively higher density profile radially outward from the core is produced.

12. The apparatus as set forth in claim 11 wherein said electrical apparatus is an electromagnetic tensioner which provides a tension on said yarn during winding which varies in accordance with said control signal applied to said electromagnetic tensioner.

13. The apparatus as set forth in claim 11 wherein said electrical apparatus includes a programmed source of control signals for providing a programmed control signal at predetermined magnitudes for predetermined times, thus to produce a wound yarn package having a variable density profile which varies in accordance with said control signal.

14. The apparatus as set forth in claim 13 wherein said control signal is a voltage signal applied to said electromagnetic tensioner for predetermined times at predetermined magnitudes.

15. A package of tensioned yarn comprising:

a core; and yarn wrapped on said core in a plurality of layers of yarn wraps on said core and having a progressively increasing tension profile from a low tension at the innermost layers to a higher tension at outermost layers of the yarn package radially outward from the core to result in a higher density for the inner to the outer layers on said core.

16. The package as set forth in claim 15, wherein said core is perforated to be suitable for dyeing said yarn in said core.

17. The package as set forth in claim 15, wherein said yarn is spun yarn.

18. A package of tensioned yarn comprising:

a core; and yarn wrapped in a plurality of layers of yarn wraps on said core, said yarn in a first layer near said core having a lower tension and a lower density and a smaller package diameter and said yarn having a progressively increasing tension from the innermost layers to outermost layers radially on the yarn package and a progressively increasing density profile radially outward from the core and said yarn in a second layer radially outward from said first layer having higher density and a greater package diameter.

19. A package of tensioned yarn as set forth in claim 18, wherein said yarn has said progressively higher tension substantially continuously in the entire package from said first layer.

20. A method for winding yarn comprising the steps of:

initiating winding of a yarn into a plurality of layers of yarn wraps on said core and into a yarn package with a predetermined yarn tension; and continuously and/or progressively increasing the tension in the yarn from the innermost layers to the outermost layers radially of the yarn package during substantially the entire winding of the yarn into the yarn package whereby the yarn package has a progressively increasing density profile radially outward from said core.

* * * * *